US010006428B2

(12) United States Patent
Yasuda et al.

(10) Patent No.: US 10,006,428 B2
(45) Date of Patent: Jun. 26, 2018

(54) ELECTROMAGNETIC FUEL INJECTION VALVE

(71) Applicant: KEIHIN CORPORATION, Shinjuku-Ku, Tokyo (JP)

(72) Inventors: Takahiro Yasuda, Tochigi (JP); Junichi Miyashita, Tochigi (JP); Masateru Moriya, Tochigi (JP); Yasuhiko Nabeshima, Tochigi (JP); Kousaku Yotoriyama, Tochigi (JP)

(73) Assignee: Keihin Corporation, Tokyo (JP)

( * ) Notice: Subject to any disclaimer, the term of this patent is extended or adjusted under 35 U.S.C. 154(b) by 0 days. days.

(21) Appl. No.: 15/354,347

(22) Filed: Nov. 17, 2016

(65) Prior Publication Data

US 2017/0145974 A1 May 25, 2017

(30) Foreign Application Priority Data

Nov. 20, 2015 (JP) ..... 2015-227443

(51) Int. Cl.
*F02M 51/06* (2006.01)
*F02M 61/20* (2006.01)
*F02M 63/00* (2006.01)

(52) U.S. Cl.
CPC ..... *F02M 61/20* (2013.01); *F02M 51/0664* (2013.01); *F02M 51/0685* (2013.01); *F02M 63/0075* (2013.01); *F02M 63/0077* (2013.01)

(58) Field of Classification Search
CPC ..... F02M 51/061; F02M 51/0614; F02M 51/0664; F02M 51/0685; F02M 61/20; F02M 63/0075; F02M 63/0077
See application file for complete search history.

(56) References Cited

U.S. PATENT DOCUMENTS 6,824,084 B2 * 11/2004 Maier ..... F02M 51/0671 239/533.11
7,051,960 B2 5/2006 Oguma
(Continued)

FOREIGN PATENT DOCUMENTS

CN 103291514 A 9/2013
CN 103807065 A 5/2014
(Continued)

OTHER PUBLICATIONS

Office Action dated Mar. 29, 2017, issued in the corresponding Japanese Patent Application 2015-227443.
(Continued)

*Primary Examiner* — Darren W Gorman
(74) *Attorney, Agent, or Firm* — Carrier Blackman & Associates, P.C.; Joseph P. Carrier; Fulchand P. Shende

(57) ABSTRACT

An electromagnetic fuel injection valve wherein a movable core disposed opposing an attracting face of a fixed core is slidably fitted onto a stem forming a valve body together with a valve part operating in cooperation with a valve seat, a valve-open side stopper is fixed to the stem so that, by making the movable core, that is attracted to the face when energizing a coil, abut against this stopper, the body is operated to open, and a valve-closed side stopper is fixed to the stem further on the seat side than the other stopper so as to restrict a stroke of the movable core between these stoppers. At least an end part of one of the valve-closed side stopper and the movable core, the end part being on a side of the other one thereof, is formed to gradually decreasing its cross-sectional area in going toward the other one.

1 Claim, 3 Drawing Sheets

(56) References Cited

U.S. PATENT DOCUMENTS

| | | | | |
|---|---|---|---|---|
| 7,458,531 | B2 | 12/2008 | Mochizuki et al. | |
| 8,430,343 | B2 | 4/2013 | Nagatomo | |
| 9,080,539 | B2 | 7/2015 | Suzaka et al. | |
| 2006/0163390 | A1* | 7/2006 | Ruehle ..... | F02M 51/0685<br>239/585.1 |

FOREIGN PATENT DOCUMENTS

| | | | |
|---|---|---|---|
| DE | 10 2006 000 286 | A1 | 12/2006 |
| JP | 2000-265919 | A | 9/2000 |
| JP | 2006-022721 | A | 1/2006 |
| JP | 2010-169041 | A | 8/2010 |
| JP | 2011-190798 | A | 9/2011 |
| JP | 2013-104340 | A | 5/2013 |
| WO | 2014/045902 | A1 | 3/2014 |

OTHER PUBLICATIONS

Official Communication dated Mar. 5, 2018, issued in the corresponding Chinese Patent Application 201611001622.1.

* cited by examiner

ELECTROMAGNETIC FUEL INJECTION VALVE

BACKGROUND OF THE INVENTION

Field of the Invention

The present invention relates to an electromagnetic fuel injection valve comprising a valve housing that has a valve seat in one end part thereof, a hollow fixed core that is provided so as to be connected to the other end of the valve housing, a coil that is disposed on an outer periphery of the fixed core, a valve body that is formed by having a stem provided so as to be connected to a valve part that operates in cooperation with the valve seat, a movable core that is slidably fitted onto the stem while being disposed so as to oppose an attracting face of the fixed core, a valve-open side stopper that is fixed to the stem so that, by making the movable core, that is attracted to the attracting face when the coil is energized, abut against the valve-open side stopper, the valve body is made to undergo a valve-opening operation, a valve-closed side stopper that is fixed to the stem further on the valve seat side than the valve-open side stopper so as to restrict a stroke of the movable core along the stem between the valve-closed side stopper and the valve-open side stopper, a valve spring that urges the valve body in a valve-closing direction, and an auxiliary spring that is provided between the valve-open side stopper and the movable core so as to exhibit a spring force that makes the movable core move away from the valve-open side stopper and abut against the valve-closed side stopper when the coil is not energized.

Description of the Related Art

Such an electromagnetic fuel injection valve is known in Japanese Patent Application Laid-open No. 2013-104340.

In such an electromagnetic fuel injection valve, when the valve opens, it is only the movable core that slides on the stem of the valve body and is attracted toward the fixed core side; after being accelerated, the movable core pushes upward the valve-open side stopper fixed to the stem against a set load of the valve spring, thus enabling the valve body to be opened promptly, and valve-opening responsiveness of the valve body can be enhanced. Furthermore, when the valve closes, the movable core urged by means of the auxiliary spring abuts against the valve-closed side stopper, and an amount of rearward rebound of the valve body due to a seating impact when the valve body is seated on the valve seat for the first time can be minimized.

An interior of the electromagnetic fuel injection valve is filled with fuel; in a valve-closed state in which the movable core abuts against the valve-closed side stopper, fuel is present in a very small gap between the movable core and the valve-closed side stopper, and viscosity of the fuel acts as a resistance during a valve opening operation of the valve body. However, in the arrangement disclosed in Japanese Patent Application Laid-open No. 2013-104340 described above, the valve-closed side stopper member is formed into a cylindrical shape having the same external diameter along its whole length, a region in which the movable core and the valve-closed side stopper abut against each other is relatively wide, the valve-opening resistance due to the viscosity of the fuel is relatively large, and there is a possibility that the valve-opening responsiveness will be degraded.

On the other hand, even in a valve-open state in which the movable core abuts against the valve-open side stopper, fuel is present in a very small gap between the movable core and the valve-open side stopper, and the viscosity of the fuel acts as a resistance during a valve closing operation of the valve body, but responsiveness during a valve closing operation is more affected by residual magnetism generated when stopping energization of the coil than by the viscosity of the fuel.

SUMMARY OF THE INVENTION

The present invention has been accomplished in light of such circumstances, and it is an object thereof to provide an electromagnetic fuel injection valve that suppresses an influence of fuel viscosity on responsiveness during a valve opening operation and improves the responsiveness when the valve opens.

In order to achieve the object, according to a first aspect of the present invention, there is provided an electromagnetic fuel injection valve comprising a valve housing that has a valve seat in one end part thereof, a hollow fixed core that is provided so as to be connected to the other end of the valve housing, a coil that is disposed on an outer periphery of the fixed core, a valve body that is formed by having a stem provided so as to be connected to a valve part that operates in cooperation with the valve seat, a movable core that is slidably fitted onto the stem while being disposed so as to oppose an attracting face of the fixed core, a valve-open side stopper that is fixed to the stem so that, by making the movable core, that is attracted to the attracting face when the coil is energized, abut against the valve-open side stopper, the valve body is made to undergo a valve-opening operation, a valve-closed side stopper that is fixed to the stem further on the valve seat side than the valve-open side stopper so as to restrict a stroke of the movable core along the stem between the valve-closed side stopper and the valve-open side stopper, a valve spring that urges the valve body in a valve-closing direction, and an auxiliary spring that is provided between the valve-open side stopper and the movable core so as to exhibit a spring force that makes the movable core move away from the valve-open side stopper and abut against the valve-closed side stopper when the coil is not energized, wherein at least an end part of either one of the valve-closed side stopper and the movable core, said end part being on a side of the other one of the valve-closed side stopper and the movable core, is formed so that a cross-sectional area of the end part gradually decreases in going toward said other one of the valve-closed side stopper and the movable core.

In accordance with the first aspect of the present invention, it is possible to reduce an area of abutment between the movable core and the valve-closed side stopper as much as possible, and to suppress an influence on valve-opening responsiveness of viscosity of fuel present in a small gap between the movable core and the valve-closed side stopper when the valve opens, thereby improving the valve-opening responsiveness.

According to a second aspect of the present invention, in addition to the first aspect, at least an end part of either one of the valve-open side stopper and the movable core, said end part being formed on a side of the other one of the valve-open side stopper and the movable core, is formed so that a cross-sectional area of the end part gradually decreases in going toward said other one of the valve-open side stopper and the movable core.

In accordance with the second aspect of the present invention, an area of abutment between the movable core and the valve-open side stopper is made as small as possible, an influence on valve-closing responsiveness of viscosity of fuel present in a small gap between the movable core and the valve-open side stopper when the valve opens is suppressed, and the valve-closing responsiveness also improves.

According to a third aspect of the present invention, in addition to the second aspect, a taper face is formed on an outer periphery or inner periphery of at least an end part of either one of the valve-closed side stopper and the movable core, said end part being on the side of the other one of the valve-closed side stopper and the movable core, and an outer periphery or inner periphery of at least an end part of either one of the valve-open side stopper and the movable core, said end part being on the side of the other one of the valve-open side stopper and the movable core.

In accordance with the third aspect of the present invention, it is possible to easily change the cross-sectional area by forming the taper face so as to change the cross-sectional area. Furthermore, since the taper faces extend around the entire periphery, it is possible to equalize and reduce the abutment region around a central axis of the stem over the entire abutting faces of the movable core and the valve-closed side stopper and over the entire abutting faces of the movable core and the valve-open side stopper, thus suppressing more effectively the influence of the fuel viscosity on the valve-opening and valve-closing responsiveness.

The above and other objects, characteristics and advantages of the present invention will be clear from detailed descriptions of the preferred embodiment which will be provided below while referring to the attached drawings.

DESCRIPTION OF THE PREFERRED EMBODIMENT

Figure 1:
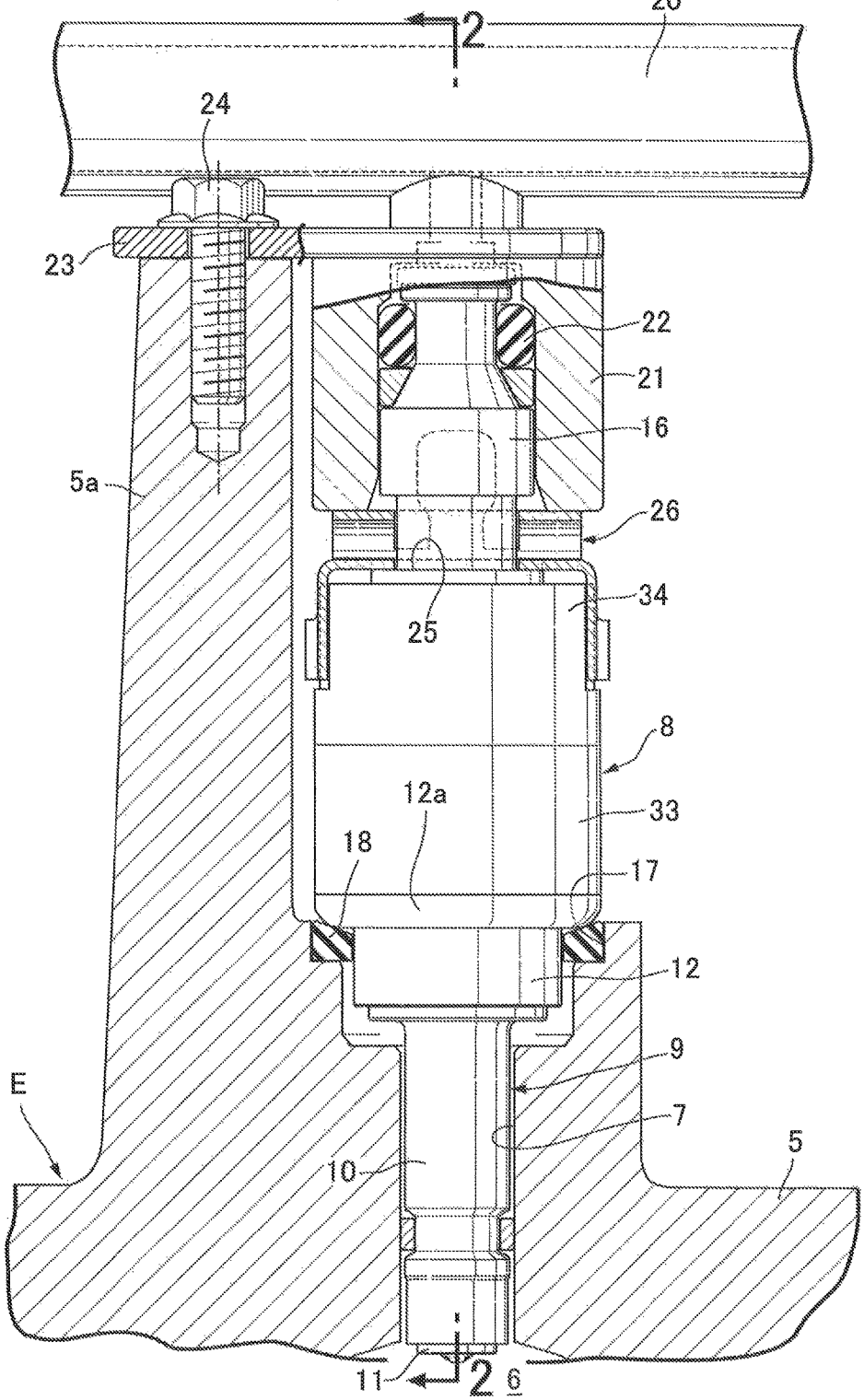
FIG. 1 is a longitudinal sectional side view of an electromagnetic fuel injection valve for an engine.
Figure 2:
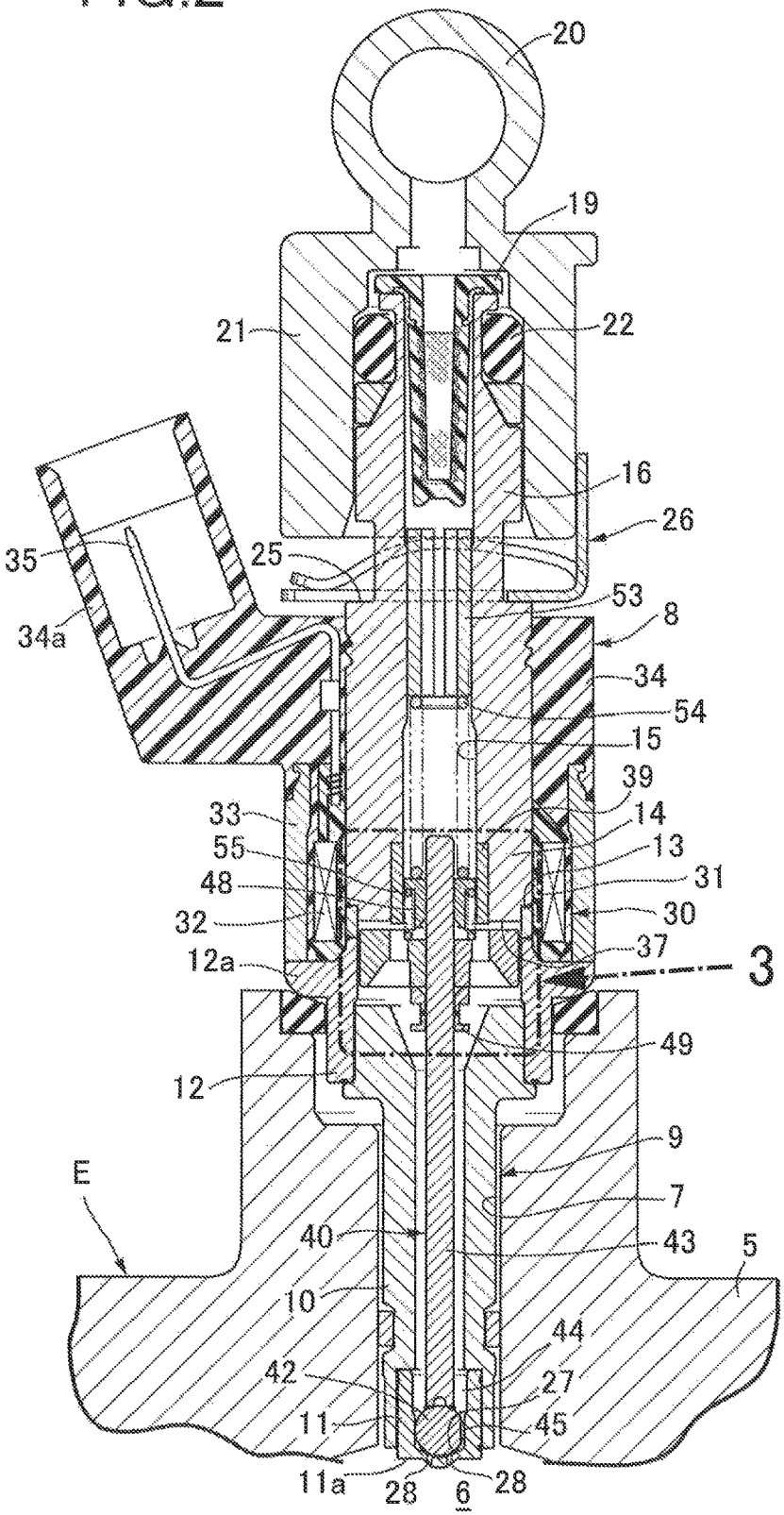
FIG. 2 is a sectional view along line 2-2 in FIG. 1.

An embodiment of the present invention is explained by reference to the attached FIG. 1 to FIG. 3. First, in FIG. 1 and FIG. 2, a cylinder head 5 of an engine E is provided with a fitting hole 7 opening in a combustion chamber 6, and an electromagnetic fuel injection valve 8 that can inject fuel toward the combustion chamber 6 is fitted into the fitting hole 7.

A valve housing 9 of the electromagnetic fuel injection valve 8 is formed from a hollow cylindrical housing body 10, a valve seat member 11 fitted into and welded to the inner periphery of one end part of the housing body 10, a magnetic cylindrical body 12 having one end part fitted onto the outer periphery of the other end part of the housing body 10 and welded to the housing body 10, and a non-magnetic cylindrical body 13 having one end part coaxially joined to the other end part of the magnetic cylindrical body 12. One end part of a fixed core 14 having a hollow part 15 is coaxially joined to the other end part of the non-magnetic cylindrical body 13, and a fuel supply tube 16 communicating with the hollow part 15 is coaxially and integrally connected to the other end part of the fixed core 14.

The magnetic cylindrical body 12 integrally has a flange-shaped yoke portion 12*a* in an intermediate part in the axial direction thereof, and a cushion material 18 housed in an annular recess 17 provided in the cylinder head 5 so as to surround the outer end of the fitting hole 7 is disposed between the cylinder head 5 and the yoke portion 12*a*.

A fuel filter 19 is fitted into the other end part, that is, an inlet, of the fuel supply tube 16, the fuel supply tube 16 is fitted, via an annular seal member 22, with a fuel supply cap 21 provided on a fuel distribution pipe 20, and a bracket 23 provided on the fuel supply cap 21 is fastened to a support post 5*a* of the cylinder head 5 by means of a bolt 24. An elastic member 26, which is formed from a plate spring, is disposed between the fuel supply cap 21 and an annular step part 25 provided on an intermediate part of the fuel supply tube 16 and facing the fuel supply cap 21 side, and the fuel supply tube 16, that is, the electromagnetic fuel injection valve 8, is clamped between the cylinder head 5 and the elastic member 26 by means of the resilient force exhibited by this elastic member 26.

The valve seat member 11 is formed into a bottomed cylindrical shape having an end wall portion 11*a* on one end part, a conical valve seat 27 is formed on the end wall portion 11*a*, and a plurality of fuel discharge holes 28 are provided so as to open in the vicinity of the center of the valve seat 27. This valve seat member 11 is fitted into and welded to one end part of the housing body 10 so that the fuel discharge holes 28 open toward the combustion chamber 6. That is, the valve housing 9 is formed so as to have the valve seat 27 on one end part of the valve housing 9.

A coil assembly 30 is fitted onto an outer peripheral face from the other end part of the magnetic cylindrical body 12 to the fixed core 14. This coil assembly 30 is formed from a bobbin 31 fitted onto the outer peripheral face and a coil 32 wound around the bobbin 31, and one end part of a coil housing 33 surrounding the coil assembly 30 is joined to the outer periphery of the yoke portion 12*a* of the magnetic cylindrical body 12.

The outer periphery of the other end part of the fixed core 14 is covered with a covering layer 34, made of a synthetic resin, molded so as to connect with the other end part of the coil housing 33, and a coupler 34*a* for retaining a terminal 35 connected to the coil 32 is formed integrally with the covering layer 34 so as to project toward one side of the electromagnetic fuel injection valve 8.

Figure 3:
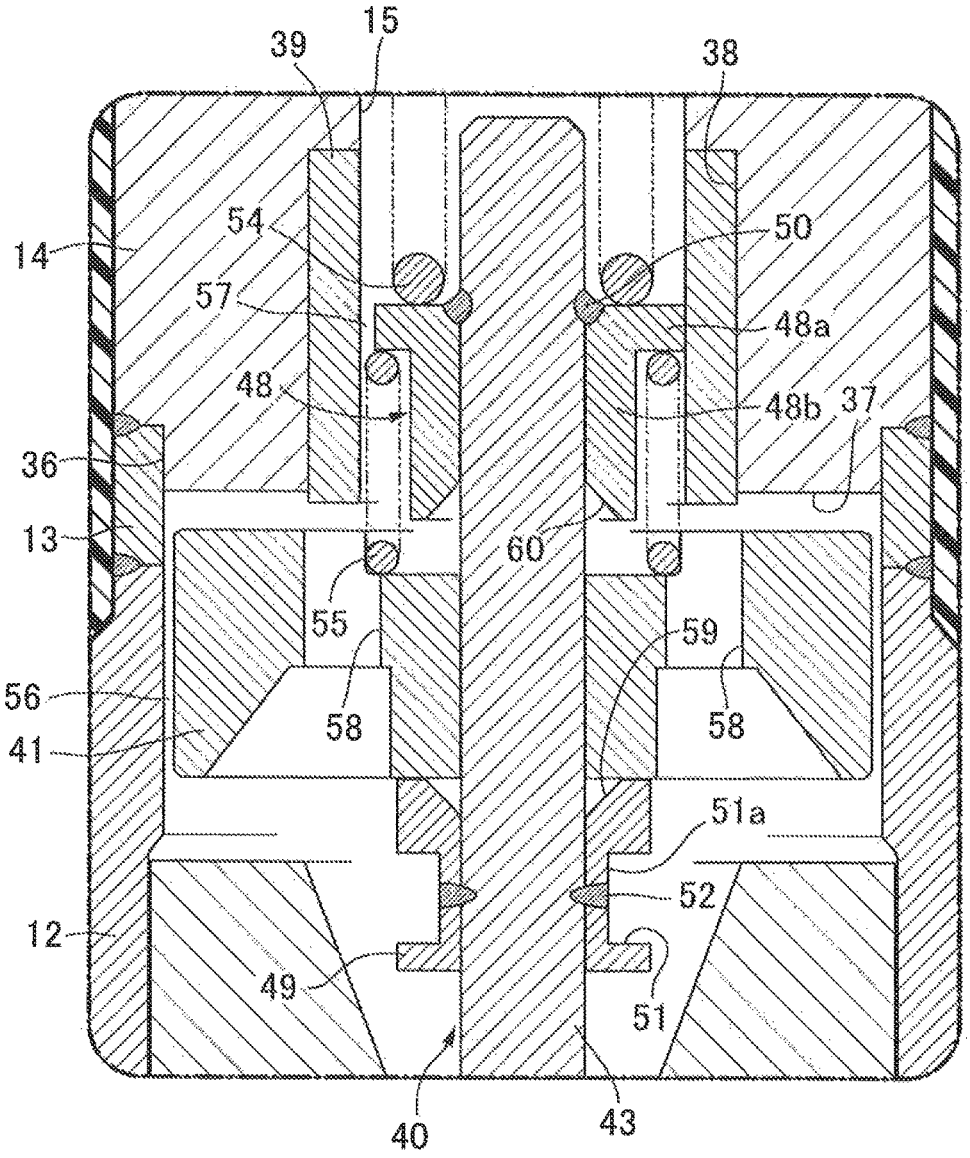
FIG. 3 is an enlarged view of a part indicated by arrow 3 in FIG. 2.

Referring in addition to FIG. 3, an annular recess 36 is formed in the outer periphery of said one end part of the fixed core 14, and the other end part of the non-magnetic cylindrical body 13 is fitted into and liquid-tightly welded to the annular recess 36 so that its outer peripheral face is continuous with the fixed core 14.

Formed in an inner peripheral face of said one end part of the fixed core 14 is a fitting recess 38 opening on an attracting face 37 at one end of the fixed core 14, and fixedly provided in the fitting recess 38 by press fitting is a cylindrical guide bush 39 so that one end part projects slightly from the attracting face 37 of the fixed core 14, an inner peripheral face of the guide bush 39 being continuous with the inner peripheral face of the fixed core 14.

One part of a valve body 40 and a movable core 41 are housed within the valve housing 9 from the valve seat member 11 to the non-magnetic cylindrical body 13. The valve body 40 is formed by providing a stem 43 so as to be connected to a valve part 42 opening and closing the fuel discharge hole 28 in cooperation with the valve seat 27, the stem 43 extending to the interior of the guide bush 39, and the valve part 42 is formed into a spherical shape so as to be in sliding contact within the valve seat member 11, the stem 43 being formed so as to have a smaller diameter than that of the valve part 42. An annular fuel flow path 44 is defined between the valve seat member 11 and the stem 43, and a plurality of flat parts 45 are formed on an outer peripheral face of the valve part 42 so as to form a fuel flow path between themselves and the valve seat member 11. Therefore, the valve seat member 11 allows fuel to pass through while guiding opening and closing of the valve body 40.

The movable core 41 is slidably fitted onto the stem 43, the movable core 41 being disposed so as to oppose the attracting face 37 of the fixed core 14. When the coil 32 is energized, the movable core 41 is attracted toward the attracting face 37 of the fixed core 14 and abuts against a valve-open side stopper 48, the valve-open side stopper 48 being fixed to the stem 43 so that the valve body 40 is opened by the movable core 41 abutting thereagainst. A valve-closed side stopper 49 is fixed to the stem 43 and is disposed further toward the valve seat 27 side than the valve-open side stopper 48 so as to restrict the stroke of the movable core 41 along the stem 43 between itself and the valve-open side stopper 48.

The valve-open side stopper 48 is formed from a flange portion 48*a* slidably fitted into an inner peripheral face of the guide bush 39 and a cylindrical shaft portion 48*b* projecting from the flange portion 48*a* toward the movable core 41 side, an inner peripheral part of the flange portion 48*a* is welded to the stem 43 by means of a weld bead 50, and the valve-open side stopper 48 is disposed so that part of the shaft portion 48*b* projects further toward the movable core 41 side than one end face of the guide bush 39 when the valve body 40 is at a valve-closed position. On the other hand, an annular groove 51 is formed in the outer periphery of the valve-closed side stopper 49, and the valve-closed side stopper 49 is fixed to the stem 43 by means of a weld bead 52 extending through a groove bottom 51*a* of the annular groove 51.

The guide bush 39 and the valve-open side stopper 48 are formed from a non-magnetic or weakly magnetic material having higher hardness than that of the fixed core 14, for example martensitic stainless steel, and have substantially equal hardness.

Referring again to FIG. 2, a pipe-shaped retainer 53 is fitted into and fixed by swaging to the hollow part 15 of the fixed core 14, and a valve spring 54 is provided in a compressed state between the retainer 53 and the flange portion 48*a* of the valve-open side stopper 48, the valve spring 54 urging the valve body 40 in a direction in which it is seated on the valve seat 27, that is, the valve-closing direction. Furthermore, an auxiliary spring 55 surrounding the shaft portion 48*b* of the valve-open side stopper 48 is provided in a compressed state between the flange portion 48*a* of the valve-open side stopper 48 and the movable core 41, this auxiliary spring 55 having a set load that is smaller than the set load of the valve spring 54 and exhibiting a spring force that urges the movable core 41 toward the side on which it moves away from the valve-open side stopper 48 and abuts against the valve-closed side stopper 49.

The other end part of the stem 43 projects from the flange portion 48*a* of the valve-open side stopper 48 and is fitted into an inner peripheral face of a movable end part of the valve spring 54, thus playing a role in positioning the valve spring 54, and the shaft portion 48*b* of the valve-open side stopper 48 is fitted into an inner peripheral face of the auxiliary spring 55 to thus play a role in positioning the auxiliary spring 55 and also contributes to shortening of the axial dimension of the electromagnetic fuel injection valve 8 by reducing the gap between the valve spring 54 and the auxiliary spring 55.

An annular gap 56 is ensured between the outer peripheral face of the movable core 41 and inner peripheral faces of the magnetic cylindrical body 12 and non-magnetic cylindrical body 13. A flat part 57 is provided at a plurality of locations of the outer periphery of the flange portion 48*a* of the valve-open side stopper 48, the flat parts 57 forming a fuel flow path, and a plurality of through holes 58 are provided in the movable core 41, the through holes 58 forming a fuel flow path.

In such an electromagnetic fuel injection valve 8, when the coil 32 is in a non-energized state, the valve body 40 is pushed by the set load of the valve spring 54 and is made to seat on the valve seat 27 to thus close the fuel discharge hole 28. That is, in the valve-closed state, the movable core 41 is retained in a state in which it is made to abut against the valve-closed side stopper 49 by the set load of the auxiliary spring 55, thus maintaining a predetermined gap from the fixed core 14.

When the coil 32 is energized in such a valve-closed state, the resulting magnetic force makes the movable core 41 be attracted to the fixed core 14 and abut against the valve-open side stopper 48 while compressing the auxiliary spring 55. That is, since at a time of initial movement the movable core 41 slides against the set load of the auxiliary spring 55, which is smaller than that of the valve spring 54, when it experiences an attracting force from the fixed core 14 it slides smoothly and abuts against the valve-open side stopper 48 while accelerating.

When the movable core 41 abuts against the valve-open side stopper 48, it smoothly pushes and moves the valve-open side stopper 48 against the set load of the valve spring 54, and the movable core 41 collides with one end of the guide bush 39 and stops. During this process, since the valve-open side stopper 48, which is pushed and moves, is fixed to the stem 43, the valve part 42 is detached from the valve seat 27, and a valve-open state is attained.

When the movable core 41 abuts against the guide bush 39 with an impact, the valve body 40, which is formed from the valve part 42 and the stem 43, overshoots due to its inertia, but since the valve-closed side stopper 49, which is integral with the valve body 40, collides with the movable core 41, the overshoot is stopped. During this process, since the valve-open side stopper 48 increases the compressive deformation of the valve spring 54 while moving away from the movable core 41 by an amount corresponding to the overshoot of the valve body 40, overshooting of the valve body 40 is also suppressed by means of the repulsive force of the valve spring 54.

When overshooting stops, the valve-open side stopper 48 is returned by means of the repulsive force of the valve spring 54 to a position at which it abuts against the movable core 41, which is abutting against the guide bush 39, and the valve body 40 is retained at a predetermined valve-opening position. In this arrangement, since the set load of the auxiliary spring 55 is set smaller than the set load of the valve spring 54, which urges the valve body 40 in the valve-closing direction, when the coil 32 is energized the auxiliary spring 55 does not interfere with attraction of the movable core 41 toward the fixed core 14 and abutment of the valve-open side stopper 48 against the movable core 41 by means of the valve spring 54, and does not inhibit opening of the valve body 40 to the predetermined position.

In this way, since in the process of opening of the valve body 40, the impact force that the movable core 41 applies to the guide bush 39 can be divided into an impact force when only the movable core 41 first collides with the guide bush 39 and an impact force when the valve-closed side stopper 49 subsequently collides with the movable core 41, each of the collision energies is relatively small, and it is possible to prevent wear of the parts via which the guide bush 39 and the movable core 41 abut against each other and to suppress the collision noise to a low level. Moreover, since when the valve-closed side stopper 49 collides against the movable core 41 the valve spring 54 is deformed by a larger amount than the amount of compressive deformation when the valve opens normally, the valve spring 54 absorbs the collision energy of the valve-closed side stopper 49 against the movable core 41, thus alleviating the impact force.

When the valve body 40 opens, fuel that is fed under pressure from a fuel pump, which is not illustrated, to the fuel supply tube 34 goes in sequence through the interior of the pipe-shaped retainer 53, the hollow part 15 of the fixed core 14, the flat part 57 around the valve-open side stopper 48, the through hole 58 of the movable core 41, the interior of the valve housing 9, and the flat part 45 around the valve part 42, and is injected from the fuel discharge hole 28 directly into the combustion chamber 6 of the engine E.

When energization of the coil 32 is subsequently cut off, since the valve-open side stopper 48 is pushed by means of the repulsive force of the valve spring 54, the valve-open side stopper 48 moves toward the valve seat 27 side together with the movable core 41 and the valve body 40, thus making the valve part 42 be seated on the valve seat 27. In this process, the movable core 41 moves with a slight delay after the valve part 42 has been seated on the valve seat 27, due to the influence of residual magnetism between the movable core 41 and the fixed core 14 and the relatively small set load of the auxiliary spring 55, which makes the movable core 41 descend forward.

When the valve body 40 is seated on the valve seat 27 for the first time, it rebounds due to the seating impact, but since the movable core 41, which descends after a delay, abuts against the valve-closed side stopper 49 fixed to the rebounding valve body 40, the amount of rebound of the valve body 40 can be minimized.

If rebounding of the valve body 40 is suppressed, the valve body 40 is retained in a valve-closed state by means of the repulsive force of the valve spring 54 to thus suspend fuel injection, and the movable core 41 is held in a state in which it is made to abut against the valve-closed side stopper 49 by means of the repulsive force of the auxiliary spring 55.

As described above, during the process of closing the valve body 40, since the impact force that the valve body 40 applies to the valve seat 27 can be divided into the impact force when only the valve body 40 is first seated on the valve seat 27 and the impact force when the movable core 41 subsequently collides with the valve-closed side stopper 49, each of the collision energies is relatively small. Furthermore, when the valve body 40 is seated on the valve seat 27 for the first time, it rebounds due to the seating impact and is subsequently seated on the valve seat 27 again and delivers an impact, but since the valve-closing stroke after the rebound of the valve body 40 is much smaller than the valve-closing stroke from the usual valve-open position of the valve body 40, the impact force acting on the valve seat 27 is very small. This enables wear of the parts where the valve part 42 and the valve seat 27 seat against each other to be prevented and the seating noise to be suppressed.

In accordance with the present invention, at least an end part of either one of the valve-closed side stopper 49 and the movable core 41, said end part being on the side of the other one of the valve-closed side stopper 49 and the movable core 41, is formed so as to have a cross-sectional area that gradually decreases in going toward said other one, in this embodiment the end part on the movable core 41 side of the valve-closed side stopper 49 being formed so that the cross-sectional area gradually decreases in going toward the movable core 41 side, and in order to change the cross-sectional area a taper face 59 (also referred to as a second taper face 59) having a diameter that increases in going toward the movable core 41 side is formed on the inner periphery or outer periphery (in this embodiment the inner periphery) of the end part on the movable core 41 side of the valve-closed side stopper 49.

Furthermore, at least an end part of either one of the valve-open side stopper 48 and the movable core 41, said end part being on the side of the other one of the valve-open side stopper 48 and the movable core 41, is formed so that its cross-sectional area gradually decreases in going toward said other one of the valve-open side stopper 48 and the movable core 41, in this embodiment the end part on the movable core 41 side of the shaft portion 48*b* of the valve-open side stopper 48 being formed so that the cross-sectional area gradually decreases in going toward the movable core 41 side, and in order to change the cross-sectional area a taper face 60 (also referred to as a first taper face 60) having a diameter that increases in going toward the movable core 41 side is formed on the inner periphery or outer periphery (in this embodiment the inner periphery) of the end part on the movable core 41 side of the shaft portion 48*b*.

The operation of this embodiment is now explained. Since at least an end part of either one of the valve-closed side stopper 49 and the movable core 41, said end part being on the side of the other one of the valve-closed side stopper 49 and the movable core 41, is formed so that its cross-sectional area gradually decreases in going toward said other one, in this embodiment the end part on the movable core 41 side of the valve-closed side stopper 49 being formed so that its cross-sectional area gradually decreases in going toward the movable core 41 side, it is possible to reduce the area of abutment between the movable core 41 and the valve-closed side stopper 49 as much as possible, and to suppress the influence on the valve-opening responsiveness of the viscosity of fuel present in the small gap between the movable core 41 and the valve-closed side stopper 49 when the valve opens, thereby improving the valve-opening responsiveness.

Furthermore, since at least an end part of either one of the valve-open side stopper 48 and the movable core 41, said end part being on the side of the other one of the valve-open side stopper 48 and the movable core 41, is formed so that its cross-sectional area gradually decreases in going toward said other one of the valve-open side stopper 48 and the movable core 41, in this embodiment the end part on the movable core 41 side of the shaft portion 48*b* of the valve-open side stopper 48 being formed so that its cross-sectional area gradually decreases in going toward the movable core 41 side, it is possible to suppress the influence on the valve-closing responsiveness of the viscosity of fuel present in the small gap between the movable core 41 and the valve-open side stopper 48 when the valve closes, thus improving the valve-closing responsiveness.

Furthermore, since in order to gradually decrease the cross-sectional area of the end part on the movable core 41 side of the valve-closed side stopper 49 in going toward the movable core 41 side, the taper face 59 having a diameter that increases in going toward the movable core 41 side is formed on the inner periphery of the end part on the movable core 41 side of the valve-closed side stopper 49, and in order to gradually decrease the cross-sectional area of the end part on the movable core 41 side of the valve-open side stopper 48 in going toward the movable core 41 side, the taper face 60 having a diameter that increases in going toward the movable core 41 side is formed on the inner periphery of the end part on the movable core 41 side of the shaft portion 48*b* of the valve-open side stopper 48, it is possible to easily change the cross-sectional area. Moreover, since the taper faces 59 and 60 extend around the entire periphery, it is possible to equalize and reduce the abutment region around the central axis of the stem 43 over the entire abutting faces of the movable core 41 and the valve-closed side stopper 49 and over the entire abutting faces of the movable core 41 and the valve-open side stopper 48, thus suppressing more effectively the influence of the fuel viscosity on the valve-opening and valve-closing responsiveness.

In particular, forming the taper faces 59 and 60 on the inner periphery of the end part on the movable core 41 side of the valve-closed side stopper 49 and on the inner periphery of the end part on the movable core 41 side of the shaft portion 48*b* of the valve-open side stopper 48 can contribute to stabilization of the behavior of the movable core 41. That is, when the movable core 41 moves between the valve-closed side stopper 49 and the valve-open side stopper 48, there is a possibility that the axis of the movable core 41 will tilt relative to the axis of the stem 43, that is, the axis of the valve-closed side stopper 49 and the valve-open side stopper 48, but when a taper face is formed on the outer periphery side of the valve-closed side stopper 49 and the valve-open side stopper 48, there is a possibility that the movable core 41 will make contact with the taper face, and destabilization of the behavior of the movable core 41 due to the above can be prevented by forming the taper faces 59 and 60 on the inner periphery side of the valve-closed side stopper 49 and the valve-open side stopper 48.

In order to suppress the influence of resistance due to the viscosity of fuel present in the small gap between the movable core 41 and the valve-closed side stopper 49 on the valve-closing responsiveness and the influence of resistance due to the viscosity of fuel present in the small gap between the movable core 41 and valve-open side stopper 48 on the valve-opening responsiveness, other than reducing the area of abutment between the movable core 41 and the valve-closed side stopper 49 and the area of abutment between the movable core 41 and the valve-open side stopper 48 as described above, it is also effective to adjust the roughness of the abutting faces.

That is, when the viscous resistance of fuel is h, the abutment width is D, the abutting face gap is H, the viscosity of the fuel, which is influenced by the type of fuel and supply pressure and temperature, is $\eta$, the relative separation speed of the abutting faces is V, and the abutment area is S, the viscous resistance=$(D^2/H^3)\times\eta\times V\times S$, and since the abutting face gap H depends on the surface roughness, the higher the roughness, the smaller the resistance.

An embodiment of the present invention is explained above, but the present invention is not limited to the above-mentioned embodiment and may be modified in a variety of ways as long as the modifications do not depart from the gist of the present invention.

What is claimed is:

1. An electromagnetic fuel injection valve comprising a valve housing that has a valve seat in one end part thereof, a hollow fixed core that is provided so as to be connected to the other end of the valve housing, a coil that is disposed on an outer periphery of the fixed core, a valve body that is formed by having a stem provided so as to be connected to a valve part that operates in cooperation with the valve seat, a movable core that is slidably fitted onto the stem while being disposed so as to oppose an attracting face of the fixed core, a valve-open side stopper that is fixed to the stem so that, by making the movable core, that is attracted to the attracting face when the coil is energized, abut against the valve-open side stopper, the valve body is made to undergo a valve-opening operation, a valve-closed side stopper that is fixed to the stem at a position further towards the valve seat than a position of the valve-open side stopper so as to restrict a stroke of the movable core along the stem between the valve-closed side stopper and the valve-open side stopper, a valve spring that urges the valve body in a valve-closing direction, and an auxiliary spring that is provided between the valve-open side stopper and the movable core so as to exhibit a spring force that makes the movable core move away from the valve-open side stopper and abut against the valve-closed side stopper when the coil is not energized, wherein one end part of the valve-open side stopper on the movable core side includes a first taper face on an inner periphery side of the one end part, the first taper face having a diameter that increases in going toward the movable core, and a first flat abutment face formed continuous to the first taper face for abutment against the movable core;

wherein one end part of the valve-closed side stopper on the movable core side includes a second taper face on an inner periphery side of the one end part of the valve-closed side stopper, the second taper face having a diameter that increases in going toward the movable core, and a second flat abutment face formed continuous to the second taper face for abutment against the movable core; and wherein the valve-closed side stopper includes a substantially U-shaped annular groove between its one end part and another end part on the valve seat side, when viewed in a longitudinal sectional view, the substantially U-shaped annular groove being formed on the valve-closed side stopper at a position closer to the valve seat side.

* * * * *